United States Patent [19]

Granetzke

[11] 3,981,356

[45] Sept. 21, 1976

[54] HEAT EXCHANGER

[75] Inventor: Dennis C. Granetzke, Racine, Wis.

[73] Assignee: Modine Manufacturing Company, Racine, Wis.

[22] Filed: June 6, 1975

[21] Appl. No.: 584,632

[52] U.S. Cl. ..... 165/179; 138/38; 138/42

[51] Int. Cl.[2] ..... F28F 1/42

[58] Field of Search ..... 138/38, 41, 42; 165/179, 174

[56] References Cited

UNITED STATES PATENTS

| | | | |
|---|---|---|---|
| 3,837,396 | 9/1974 | Mewton | 138/38 |

FOREIGN PATENTS OR APPLICATIONS

| | | | |
|---|---|---|---|
| 1,593,142 | 7/1970 | France | 138/38 |
| 995,294 | 11/1951 | France | 165/179 |
| 857,707 | 1/1961 | United Kingdom | 165/179 |

*Primary Examiner*—Charles J. Myhre
*Assistant Examiner*—Theophil W. Streule, Jr.
*Attorney, Agent, or Firm*—Wegner, Stellman, McCord, Wiles & Wood

[57] ABSTRACT

A heat exchanger that includes a heat exchange tube for flow of a liquid therethrough and including a turbulator on the interior of the tube at the inner wall surface thereof with the turbulator comprising a strip of expanded metal arranged in a helix and having spacing projections at the opposite side edges of the strip with the spacing projections being integral with the expanded metal and in contact with the inner surface of the tube for spacing the turbulator from the wall surface. The strands and bridges of the expanded metal which define the openings through the metal are arranged with relation to the tube axis and the wall surface to direct a portion of the liquid toward the inner wall surface for controlled heat transfer and to direct the remainder of the liquid flow adjacent to the wall surface toward the main liquid stream on the interior of the tube, thereby achieving improved and preselected heat transfer through the tube wall with minor pressure drop of the liquid flowing through the tube.

7 Claims, 7 Drawing Figures

HEAT EXCHANGER

BACKGROUND OF THE INVENTION

The invention relates to a tubular heat exchanger having controlled and improved heat transfer through the liquid film that is normally present within the tube adjacent the tube wall and including a turbulator on the interior of the tube in contact with the inner surface of the tube wall in which the turbulator comprises expanded metal adjacent to this wall surface with spacing projections of selected length and configuration, with the bridges and strands of expanded metal being angled with respect to the axis of the tube and the wall surface to direct preselected amounts of the flowing liquid toward the wall surface to improve the heat transfer by controlling skin effect of the liquid without excessive pressure drop in the liquid flowing through the tube.

DESCRIPTION OF THE PREFERRED EMBODIMENTS

Figure 7:
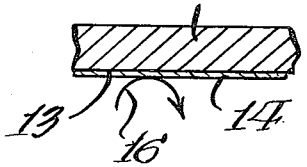
FIG. 7 is an enlarged sectional detail view of the tube wall illustrating the operation of the invention.

In the embodiment of FIGS. 1–3 and 5 the heat exchanger comprises a tube 10 through which is adapted to be directed a heat exchange liquid 11 in which the tube is defined by a wall 12 having an inner surface 13. As is well known in heat exchange art a liquid 11 in contact with a wall surface 13 establishes a very thin film or skin which is so small as to be ordinarily invisible. This thin film 14 which is illustrated in greatly enlarged detail in FIG. 7 acts as an insulating heat barrier to the passage of heat through the wall 12 as to the exterior fins 15 illustrated in the embodiment of FIG. 6.

By employing a turbulator adjacent to the inner surface 13 of the wall, however, the thickness and thus the insulating factor of this film 14 can be regulated. In general, the greater the tubulence adjacent to the film 14 as illustrated by the curved arrow 16 the thinner the film and the less its insulating effect.

Figure 1:
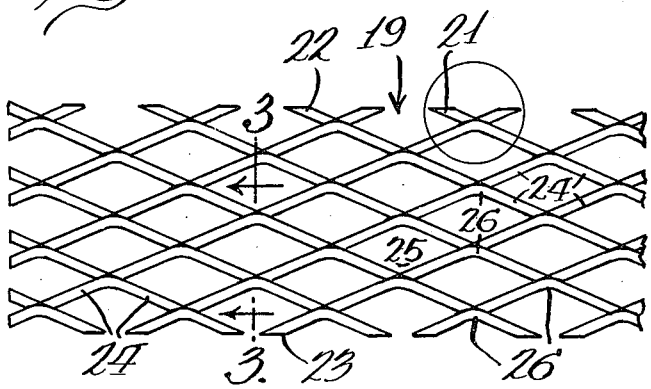
FIG. 1 is a plan view of a section of expanded metal comprising the turbulator of the heat exchanger of this invention.
Figure 2:
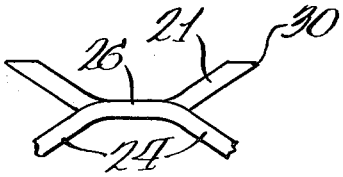
FIG. 2 is an enlarged detail of the expanded metal of FIG. 1 that is enclosed within the circle thereon.
Figure 4:
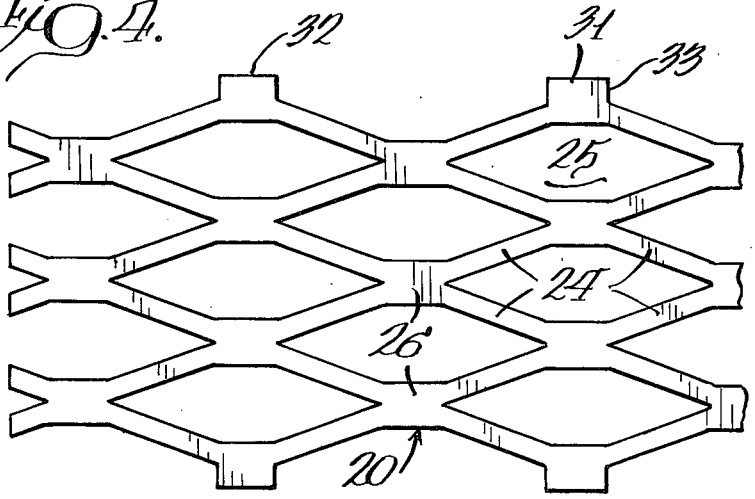
FIG. 4 is similar to FIG. 1 but enlarged and illustrating a second embodiment of the turbulator.
Figure 5:
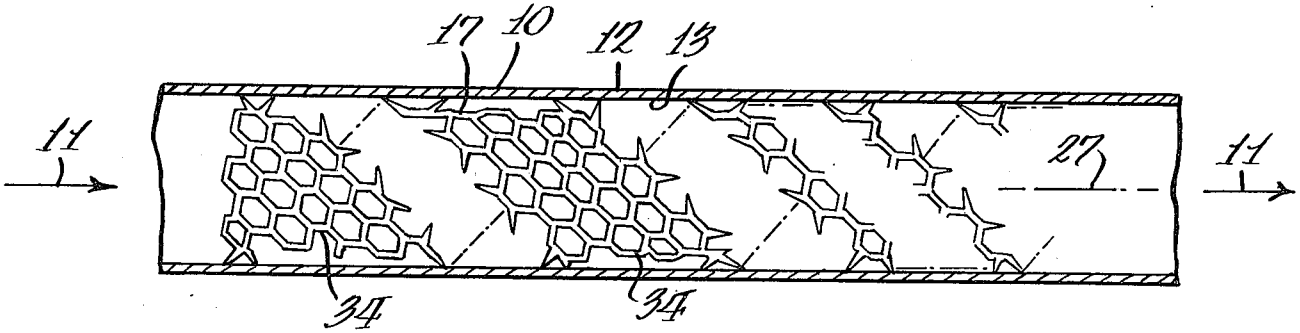
FIG. 5 is a longitudinal section through the first embodiment of the invention.
Figure 6:
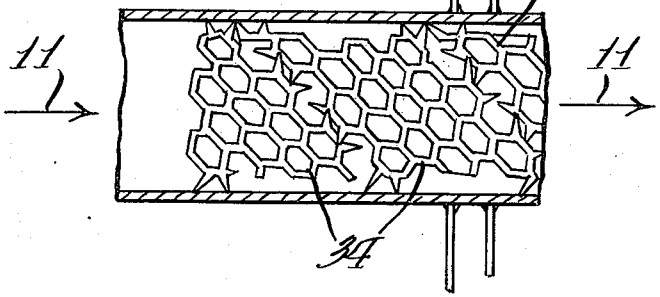
FIG. 6 is a view similar to FIG. 5 but illustrating a second embodiment of the heat exchanger.

The turbulators 17 and 18 of the two embodiments of FIGS. 5 and 6 are each made from a strip of expanded metal 19 as illustrated in FIG. 1 or a strip of expanded metal 20 as illustrated in the embodiment of FIG. 4. The strip 19 is provided with projecting spurs 21 shown in enlarged detail in FIG. 2. These spacing projections or spurs 21 are located at the opposite side edges 22 and 23 of the strip 19 and thus at the opposite side edges of the coils when the strip 19 is arranged in a helix as shown in FIGS. 5 and 6.

As is customary the expanded metal strip 19 and 20 comprises strands 24 that are separated to define openings 25 through the metal and bridges 26 that connect the adjacent ends of the strands together.

Figure 3:
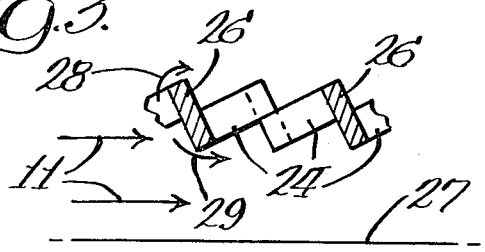
FIG. 3 is an enlarged sectional view taken substantially along line 3—3 of FIG. 1.

As is illustrated in the section detail of FIG. 3 the bridges 26 are at an angle to the axis 27 of the tube 12 and thus to the inner wall surface 13. This angular arrangement of the bridges 26 directs a portion 28 (FIG. 3) of the flowing liquid 11 toward the wall surface 13 and in general the greater the amount of liquid directed toward this surface as shown by the arrow 16 in FIG. 7 the thinner the film and thus the better the heat transfer.

This, of course, also has the effect of increasing the pressure drop of the liquid 11 flowing through the tube 12. Another portion of the liquid illustrated by the arrow 29 in FIG. 3 is directed by the sloped bridges 26 and also be the sloped strands 24 toward the central axis 27 of the tube and this of course has the effect of reducing the pressure drop. Therefore, the degree of pressure drop of the liquid flowing through the tube and the thickness of the interfacial film 14 both can be preselected and regulated by not only the slope of the strands 24 and connecting bridges 26 relative to the axis 27 of the tube but also by the length of the spacing projections 21 which of course determines the spacing of the turbulator from the inner wall surface 13. In fact, this predetermination of the heat transfer coefficient through the tube wall 12 and the degree of pressure drop of the liquid flowing through the tube by such simple means as the length of the expanded metal projections 21 and the slope of the strands 24 and bridges 26 is one of the principal advantages of this invention plus, of course, the simplicity of the structure and the inexpensiveness of the expanded metal.

Because the spurs 21 have such sharp points 30 left by cutting the expanded metal to define the side edges 22 and 23 there is danger to the workman and it is primarily for this reason that the embodiment of FIG. 4 is also provided. In this embodiment the spacing projections are the remainder 31 of the connecting bridges 26 at the edge 32 after the outermost strands on the edge bridges have been removed to leave the square bridge edges 33. Otherwise, the expanded metal turbulator 20 of the FIG. 4 embodiment is the same as the turbulators of the FIGS. 1, 2 and 3 embodiment.

The expanded metal turbulator of this invention not only has the advantages as stated above of permitting preselecting the heat transfer coefficient and the pressure drop to the liquid flow by regulating the length of the spacers 21 and 31, but the pressure drop and heat transfer coefficient can also be regulated by arranging the expanded metal in strip form 19 and 20 and in helical coils illustrated in the embodiment of FIGS. 5 and 6. In FIG. 5 these helical coils 34 are spaced from each other so that there is a smaller mass of expanded metal per unit length of the tube than in the embodiment of FIG. 6 where the coils 34 are in substantial edge contact. Obviously, the larger amount of metal per unit length in the embodiment of FIG. 6 will cause a greater pressure drop in the flowing liquid 11 than the smaller mass of metal and the greater spacing of the coils in the embodiment of FIG. 5.

I claim:

1. A heat exchanger, comprising: a heat exchange tube for flow of a heat exchange liquid therethrough; and a turbulator on the interior of said tube and in contact with the inner surface of the tube wall, said turbulator comprising an expanded metal member arranged in a flat helix comprising coils located adjacent and substantially parallel to said wall surface, and having side edges with spacing projections integral with the expanded metal, said projections extending outwardly of said helix coils and in contact with the inner surface of the tube for spacing the expanded metal helix turbulator from the tube inner surface, said expanded metal comprising separated strands defining openings through the metal and connecting bridges for said strands with the strands and bridges having side surface means at an angle to said helix and thus to said wall surface for directing a preselected portion of the liquid in the tube toward the inner wall surface and the remainder toward the main liquid stream on the interior of the tube, thereby achieving improved heat transfer through said tube wall with minor pressure drop of said liquid flow through the tube.

2. The heat exchanger of claim 1 wherein there are provided means on the exterior of said tube for transferring heat through the tube wall from said liquid to a heat exchange fluid on the exterior of the tube.

3. The heat exchanger of claim 2 wherein said heat transfer means comprises fins.

4. The heat exchanger of claim 1 wherein said flat helix coils have said side edges of adjacent coils in substantial contact with each other.

5. The heat exchanger of claim 1 wherein said flat helix coils have said side edges of adjacent coils spaced from each other.

6. The heat exchanger of claim 1 wherein said spacing projections comprise spurs each comprising a fragmentary portion of a strand projecting from a bridge.

7. The heat exchanger of claim 1 wherein said projections comprise bridges remaining after the outermost strands on each bridge located at a said edge of said helix have been separated therefrom so as to provide blunt lateral projections extending from said edges of said helical coils.

* * * * *